US010427021B2

(12) United States Patent
Lewis

(10) Patent No.: US 10,427,021 B2
(45) Date of Patent: Oct. 1, 2019

(54) COMBAT TRAINING DEVICE

(71) Applicant: Rashon Q. Lewis, Missouri City, TX (US)

(72) Inventor: Rashon Q. Lewis, Missouri City, TX (US)

( * ) Notice: Subject to any disclaimer, the term of this patent is extended or adjusted under 35 U.S.C. 154(b) by 324 days.

(21) Appl. No.: 15/042,760

(22) Filed: Feb. 12, 2016

(65) Prior Publication Data

US 2017/0232320 A1 Aug. 17, 2017

(51) Int. Cl.
*A63B 69/20* (2006.01)
*A63B 23/12* (2006.01)
(Continued)

(52) U.S. Cl.
CPC ..... *A63B 69/208* (2013.01); *A63B 21/285* (2013.01); *A63B 23/12* (2013.01); *A63B 69/20* (2013.01); *A63B 69/26* (2013.01); *A63B 21/02* (2013.01); *A63B 21/16* (2013.01); *A63B 69/201* (2013.01); *A63B 2210/50* (2013.01); *A63B 2225/09* (2013.01); *A63B 2244/10* (2013.01)

(58) Field of Classification Search
CPC ..... A63B 69/20; A63B 69/201; A63B 69/203; A63B 69/205; A63B 69/208; A63B 69/24; A63B 69/26; A63B 69/32; A63B 69/325; A63B 69/34; A63B 69/345; A63B 2244/10; A63B 2244/102; A63B 2244/104; A63B 2244/106
USPC ..... 482/87, 88
See application file for complete search history.

(56) References Cited

U.S. PATENT DOCUMENTS 2,400,105 A * 5/1946 Costello ..... A63B 69/20 482/88
7,611,413 B2 * 11/2009 Ryan ..... A61F 5/37 119/801
7,828,701 B1 * 11/2010 Chen ..... A63B 69/004 482/83

(Continued)

OTHER PUBLICATIONS

Web page printout of www.impacthead.net, Reality-Based impact Head (2 pages).

(Continued)

*Primary Examiner* — Joshua Lee
(74) *Attorney, Agent, or Firm* — Quisenberry Law PLLC

(57) ABSTRACT

A combat training device may include an elongated support having a shoulder rest at a rearward end and a punching target at a forward end. The punching target may be attached to a neck support adapted for removable engagement with the forward end of the elongated support. The device may further include a punching assembly having a reciprocating support with a handle at its rearward end and a punching member at its forward end. The reciprocating support may be disposed for longitudinal movement in generally parallel relationship to the elongated support. The reciprocating support may be rotatably disposed within a longitudinal bore that is disposed in generally parallel relationship to the elongated support and reciprocating support. The shoulder rest may be releasably engageable with the rearward end of the elongated support and moveable between adjustable locked positions, such as through the use of a detent mechanism. A punching target holder may be provided for attachment to a punching bag for use in removably attaching a neck support and attached punching target to the punching bag.

19 Claims, 4 Drawing Sheets

(51) Int. Cl.

| | |
|---|---|
| ***A63B 69/26*** | (2006.01) |
| ***A63B 21/28*** | (2006.01) |
| *A63B 21/02* | (2006.01) |
| *A63B 21/16* | (2006.01) |

(56) References Cited

U.S. PATENT DOCUMENTS 7,927,259 B1 * 4/2011 Rix ..... A61H 7/005 482/83
8,777,631 B1 * 7/2014 Fletcher ..... A63B 69/26 434/247
9,022,904 B1 * 5/2015 Dorsey ..... A63B 69/004 482/83
2004/0180762 A1 * 9/2004 Phillips ..... A63B 69/004 482/88
2006/0003854 A1 * 1/2006 Hansberry ..... A63B 69/0002 473/423
2007/0093362 A1 * 4/2007 Clayton ..... A63B 21/0004 482/88
2012/0122634 A1 * 5/2012 Lee ..... A63B 69/0091 482/83
2012/0214648 A1 * 8/2012 Schlicher ..... A63B 69/203 482/87
2014/0024503 A1 * 1/2014 Chiang ..... A63B 69/004 482/83
2015/0018132 A1 * 1/2015 Lovelace ..... A63B 69/0002 473/458
2015/0209642 A1 * 7/2015 Winter ..... A63B 69/34 482/83

OTHER PUBLICATIONS

Web page printout of http://store.jimwagnerrealitybased.com/reality-basedimpacthead.aspx, Reality-Based Impact Head, Reality-Based Personal Protection Online Store (2 pages).

* cited by examiner 10
12
13
14
15
16
17
18
20
22
24
24a
24b
26
30
32
33
α

COMBAT TRAINING DEVICE

BACKGROUND OF THE INVENTIONS

1. Field of the Inventions

The present inventions generally pertain to the field of training for hand-to-hand fighting or combat, and more particularly to more lifelike training devices and methods for combat and hand-to-hand fighting instruction in comparison to traditional sparring devices and methods.

2. Description of the Related Art

It is well-known in boxing and mixed-martial-arts (MMA) fighting circles to train for fights by sparring with a trained instructor who holds and moves hand pads for the fighter to strike. A trained instructor, however, is not always available to the fighter. The quality of training in this manner is diminished when the person holding and moving the hand pads is not a trained, experienced instructor. As such, there has developed a need for a training device and method that can be used by an inexperienced instructor or sparring partner that will still give the fighter a quality and more life-like training session. As explained below, the present inventions solve this need in the art.

SUMMARY OF THE INVENTIONS

The present inventions generally relate, in one aspect, to a combat training device comprising: an elongated support having a rearward end and a forward end; the elongated support having a shoulder rest at the rearward end of the elongated support; the elongated support having a neck support at the forward end of the elongated support; and a punching target connected to the neck support. Another feature of this aspect of the present inventions may be that the shoulder rest may be a butt stock. Another feature of this aspect of the present inventions may be that the shoulder rest may be an inverted "J" member adapted to be hooked over a human shoulder. Another feature of this aspect of the present inventions may be that the neck support may extend upwardly away from the elongated support at an angle. Another feature of this aspect of the present inventions may be that the punching target may be in the shape of a human head. Another feature of this aspect of the present inventions may be that the neck support may be resilient and have a static position, and may be adapted to return to its static position after impact with a punching force. Another feature of this aspect of the present inventions may be that the neck support with attached punching target may be removably attached to the elongated support. Another feature of this aspect of the present inventions may be that the elongated support may further include a plurality of apertures at its rearward end and a moveable support attached to the shoulder rest and include a detent for releasable and locking engagement with one of the apertures. Another feature of this aspect of the present inventions may be that the forward end of the elongated support may further include a socket and the neck support with attached punching target may be removably attachable to the socket.

In another aspect, the present inventions may be a combat training device comprising: an elongated support having a rearward end, a forward end and a sleeve housing, the sleeve housing including a longitudinal bore; a punching target connected to the forward end of the elongated support; and a reciprocating support slidably disposed within the longitudinal bore of the sleeve housing and moveable between a rearward position and a forward position, the reciprocating support including a handle at a rearward end thereof and a punching member at a forward end thereof. Another feature of this aspect of the present inventions may be that the longitudinal bore of the sleeve housing may be generally parallel to the elongated member and the reciprocating support. Another feature of this aspect of the present inventions may be that the reciprocating support may be rotatable within the longitudinal bore of the sleeve housing. Another feature of this aspect of the present inventions may be that the combat training device may further include a neck support attached to the punching target, and the neck support may be removably attached to the forward end of the elongated support. Another feature of this aspect of the present inventions may be that the forward end of the elongated support may further include a socket and the neck support with attached punching target may be removably attachable to the socket. Another feature of this aspect of the present inventions may be that the elongated support may further include a shoulder rest at the rearward end of the elongated support. Another feature of this aspect of the present inventions may be that the shoulder rest may comprise one of a buttstock and an inverted "J" member. Another feature of this aspect of the present inventions may be that the elongated support may further include a plurality of apertures at its rearward end and a moveable support attached to a shoulder rest and include a detent for releasable and locking engagement with one of the apertures.

In another aspect, the present inventions may comprise a punching target holder for attachment to a punching bag comprising: a support member having a socket adapted for releasable engagement with a neck support having a punching target attached thereto; and a cord adapted for attachment to the support member to secure the support member to the punching bag. Another feature of this aspect of the present inventions may be that the support member may include a transverse concave support and an upright concave support. Another feature of this aspect of the present inventions may be that each end of the transverse concave support and the upright concave support may further include a protective foam pad. Another feature of this aspect of the present inventions may be that the socket may extend upwardly away from the support member at an angle.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figures 1, 5, 6:
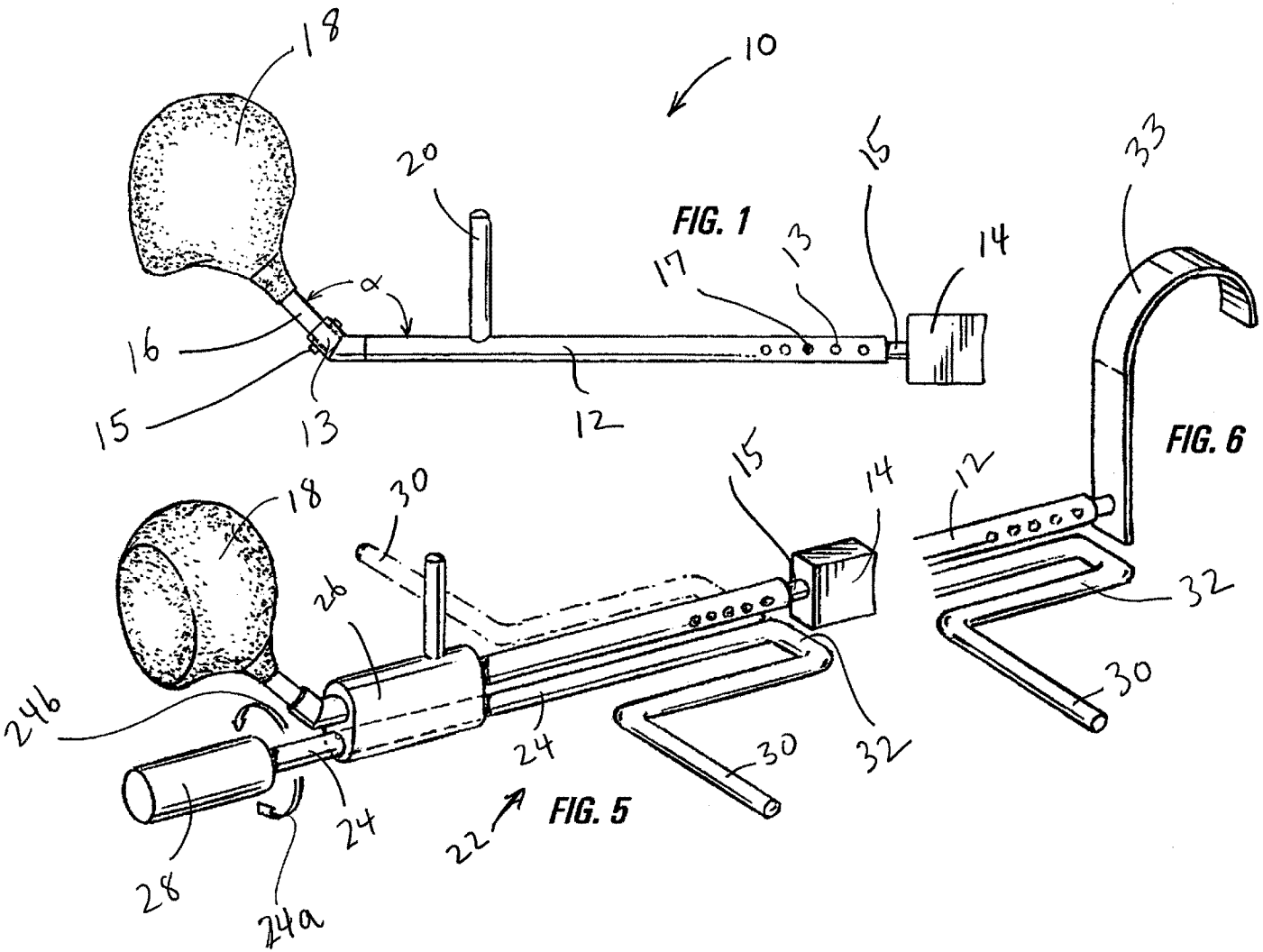
FIG. 1 is a side view showing a specific embodiment of a combat training device constructed in accordance with one aspect of the present inventions.
FIG. 5 is a perspective view of the specific embodiment of the combat training device shown in FIG. 2, with the punching assembly shown in its first/rearward position with its handle shown positioned on the left-hand side of the device in solid lines, and further illustrating that the punching assembly is rotatable so that the handle can move up and down during use and can also be rotated to the right-hand side of the device as shown in dashed lines.
FIG. 6 is a perspective view of a rearward end of a specific embodiment of a combat training device constructed in accordance with one aspect of the present inventions, and illustrating an inverted "J" shoulder support that may be used instead of a buttstock, such as shown in FIG. 4.

Referring to the drawings in detail, wherein like numerals denote identical elements throughout the several views, and referring initially to FIG. 1, there is shown a specific embodiment of a combat training device 10 that may include an elongated support 12 having a buttstock or shoulder rest 14 at a rearward end of the elongated support 12 for engagement with a person's shoulder, and a neck support 16 at an opposite, or forward, end of the elongated support 12. In a specific embodiment, the neck support 16 may extend upwardly away from the elongated support 12 at any angle $\alpha$ relative to the elongated support 12. In a specific embodiment, the angle $\alpha$ may be in the range of 30 to 60 degrees. In another specific embodiment, the angle $\alpha$ may be in the range of 40 to 50 degrees.

The combat training device 10 further includes a punching target 18 attached to the neck support 16. In a specific embodiment, the punching target 18 is preferably in the shape of a human head, such as, for example, a mannequin head. In a specific embodiment, the punching target 18 may be constructed from polyurethane-coated foam. In a specific embodiment, the neck support 16 may be constructed from a resilient or flexible material to allow the punching target 18 to move backwards relative to the elongated support 12 when the punching target 18 is struck by a fighter's fist and then spring back into its original position. In a specific embodiment, the combat training device 10 may further include a handle 20 connected to the elongated support 12. In a specific embodiment, the punching target 18 may be removably attached to the neck support 16. For example, in a specific embodiment, the forward end of the elongated support 12 may include a socket 13 sized to snugly receive the neck support 16 (with attached punching target 18) and the neck support 16 may be removably secured in the socket 13 in any known manner, such as via a bolt/screw 15, for example. The punching target 18 and neck support 16 are shown in a detached position in FIG. 2, discussed below.

Figure 2:
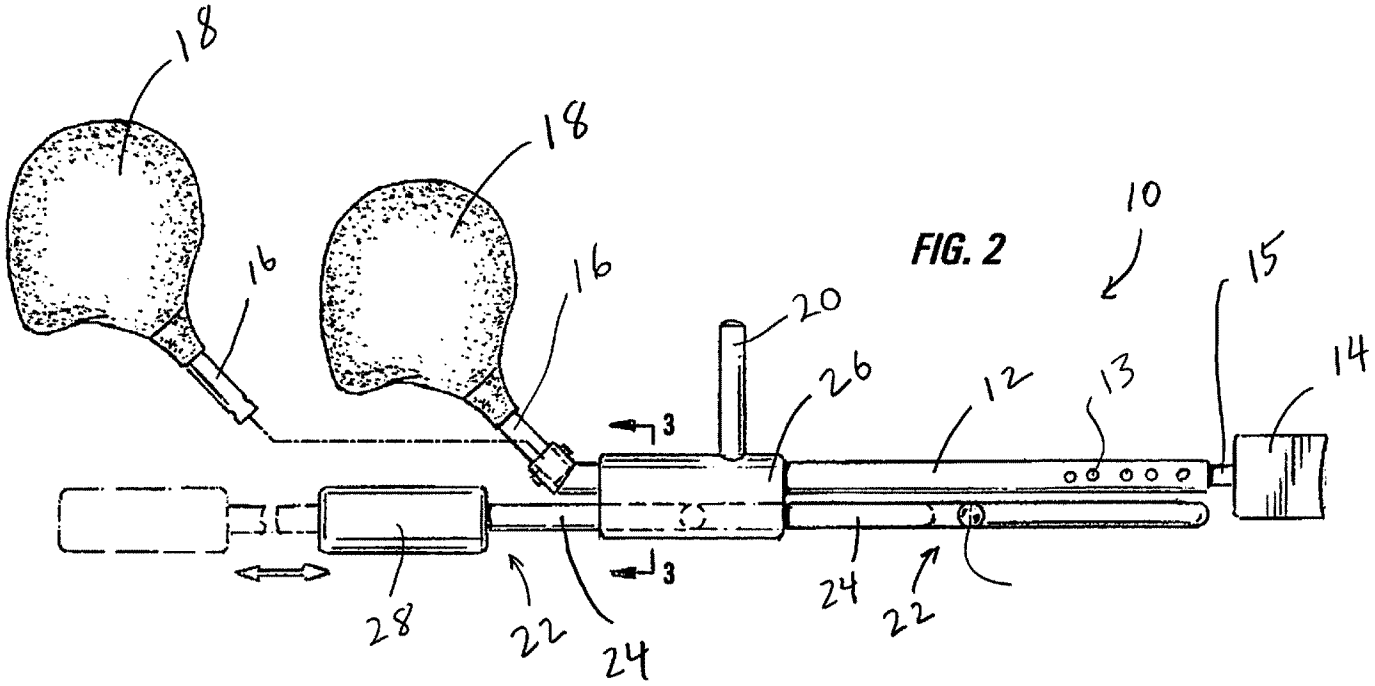
FIG. 2 is another side view similar to FIG. 1 showing another specific embodiment of a combat training device constructed in accordance with one aspect of the present inventions, which further includes a punching assembly shown in a first, or rearward, position in sold lines, and in a second, or forward, position in dashed lines.

Referring now to FIGS. 2 and 5, in another specific embodiment of the present inventions, the combat training device 10 may further include a punching assembly 22. In FIG. 2, the punching assembly 22 is shown in a rearward position in solid lines, and in a forward position in dashed lines. In a specific embodiment, the punching assembly 22 may include a reciprocating support 24 disposed for longitudinal, reciprocating movement within a sleeve housing 26 attached to the elongated support 12. In a specific embodiment, the reciprocating support 24 may be disposed in generally parallel relationship with the elongated support 12. In a specific embodiment, the elongated support 12 and the sleeve housing 26 may be formed of a unitary, one-piece structure. The reciprocating support 24 may include a striking or punching member 28 attached to a forward end of the reciprocating support 24. In a specific embodiment, the punching member 28 may be in the general shape of a human fist. In a specific embodiment, a rearward end of the reciprocating support 24 may include a handle 30, as also shown in FIG. 5. In a specific embodiment, as best shown in FIG. 5, a U-shaped transition section 32 may be provided between the reciprocating support 24 and the handle 30 to allow the handle 30 to move forwardly relative to the sleeve 26, for example. The punching assembly 22 is moveable between its rearward position, as shown in solid lines in FIG. 2 and as also shown in FIG. 5, and its forward position, as shown in dashed lines in FIG. 2.

Figure 3:
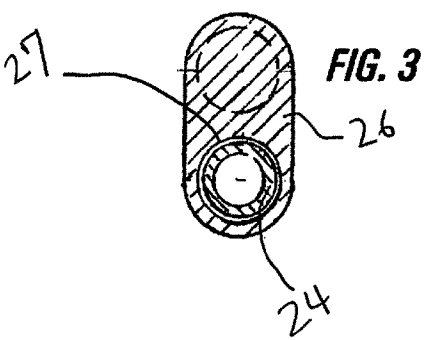
FIG. 3 is a cross-sectional view taken along line 3-3 of FIG. 2.

In a specific embodiment, the reciprocating support 24 may also be rotatable about a longitudinal axis of the sleeve 26. For example, as shown in FIG. 3, which is a cross-sectional view taken along line 3-3 of FIG. 2, the sleeve housing 26 may include a tubular inner bore 27 and the reciprocating support 24 of the punching assembly 22 may be provided with a circular cross-section and sized for longitudinal and rotatable movement within the tubular inner bore 27. The inner bore 27 preferably has a longitudinal axis that is generally parallel to and coaxial with a longitudinal axis of the elongated support 12. By allowing the reciprocating support 24 to rotate within the tubular inner bore 27, as indicated for example by arrows **24*a* and 24*b* in FIG. 5, the handle 30 of the punching assembly 22 may be moved up and down to accommodate the preferred punching position of the sparring partner/trainer operating the combat training device 10. In the regard, in FIG. 5, the handle 30 is shown in solid lines on the left-hand side of the device 10, but has been rotated to the opposite, or right-hand, side of the device 10 (and shown in dashed lines) to accommodate a trainer who wishes to operate the device with his or her right hand. If rotation of the reciprocating support 24 is not desired, then the bore 27** need not be of circular cross-section but may be in any cross-sectional shape or configuration. In this regard, the term "bore" is not limited to any particular cross-sectional configuration or shape but instead is intended to encompass any passageway of any cross-sectional configuration or shape, including but not limited to circular.

Figure 7:
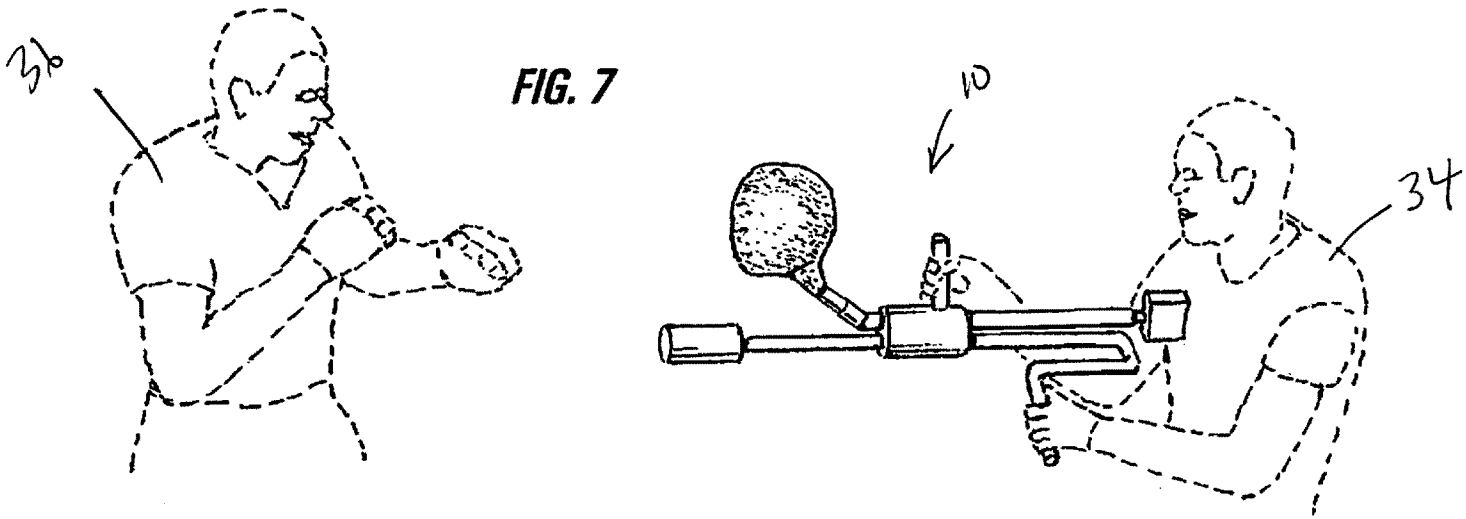
FIG. 7 is a perspective view showing a specific embodiment of a combat training device in use by a combat trainee and a combat trainer, each shown in dashed lines.
Figure 8:
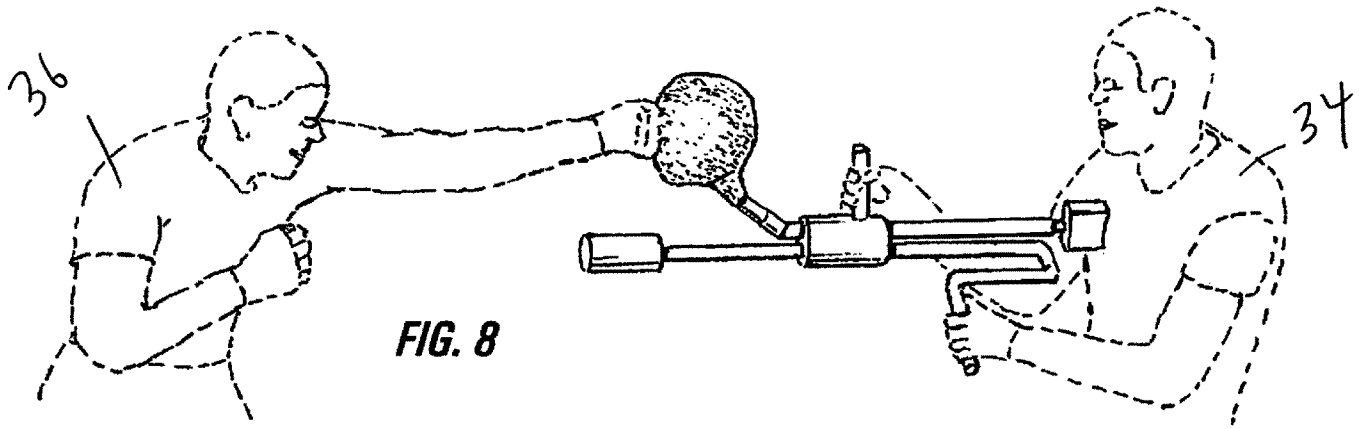
FIG. 8 is a perspective view similar to FIG. 7, but showing the combat trainee landing a left-hand jab on the punching target of the combat training device.

In use, with reference for example to FIGS. 7 and 8, a trainer or sparring partner 34 using the combat training device 10 to spar with a trainee or fighter 36 may grasp the handle 20 with one hand and grasp the handle 30 of the punching assembly 22 with the other hand, and hold the punching target 18 up for the trainee to punch. In addition, using the hand grasping the handle 30, the trainer 34 may (A) longitudinally move the punching assembly 22 forwardly and backwardly in reciprocating fashion by moving the reciprocating support 24 back and forth in the sleeve housing 26 if the trainer wishes to throw a punch at the trainee 36 with the punching member 28, and/or (B) rotate the reciprocating support 24 within the sleeve housing 26 by moving the handle 30 to whatever position is deemed desirable by the trainer. It is noted that if a handle 20 is not provided, then the trainer 34 can simply hold the device 10 by grasping the elongated support 12 and/or the sleeve housing 26.

Figure 4:
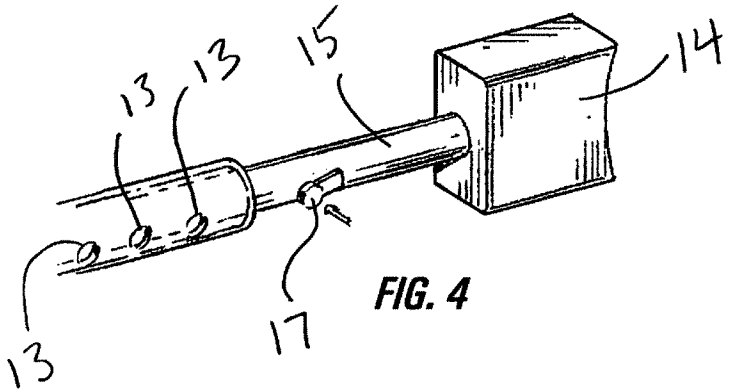
FIG. 4 is a perspective view a buttstock with a detent mechanism that may be included as part of a specific embodiment a combat training device constructed in accordance with the present inventions.

FIGS. 1, 2 and 5 further illustrate that, in a specific embodiment, the buttstock/shoulder rest 14 may be adjustable between various positions through the use of a detent mechanism. In this embodiment, the buttstock 14 may include a support member 15 adapted for slidable engagement within the elongated support 12. In a specific embodiment, the support member 15 and the elongated support 12 may be in the form of a hollow tube. With reference to FIG. 4, the buttstock 14 of this embodiment may be provided with a detent 17 adapted for engagement with a plurality of apertures 13 in the elongated support 12 in a known manner to lock the buttstock 14 to the elongated support 12 in one of its adjustable positions. As shown for example in FIG. 1, the detent 17 is shown engaged with one of the aperture 13. With reference to FIG. 6, in a specific embodiment, instead of a buttstock 14, the device 10 may be provided with an inverted "J" shoulder rest 33 adapted to hook over a trainer's shoulder.

Figure 10:
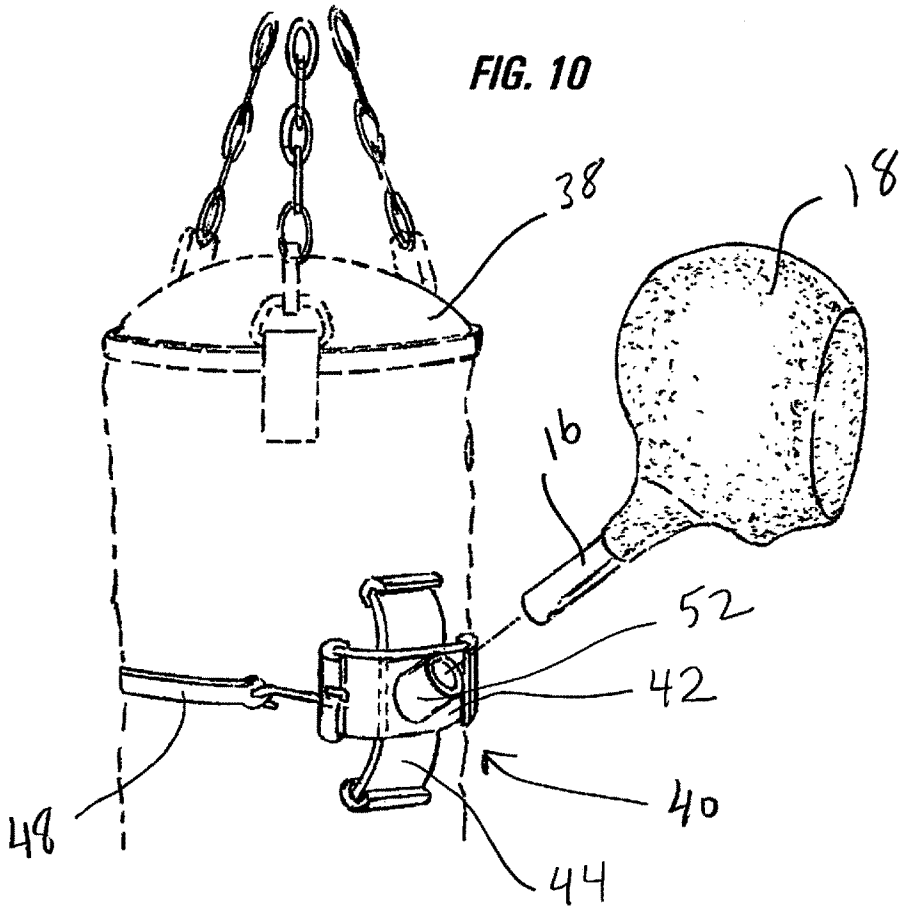
FIG. 10 is a perspective view similar to FIG. 9, but showing the punching target removed from the punching target support member.
Figure 9:
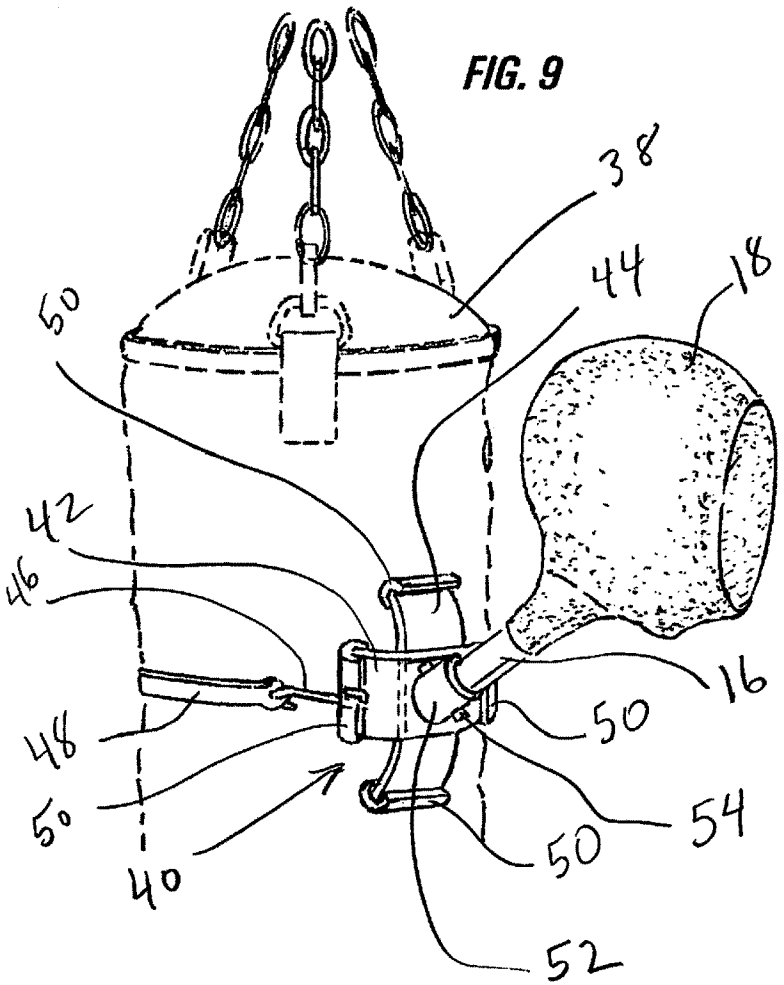
FIG. 9 is a perspective view of a punching bag with a punching target shown engaged with a punching target support member that is attached to the punching bag.

In another specific embodiment, as shown in FIGS. 9 and 10, the punching target 18 may be removably attachable to a punching bag 38 via a punching target holder 40. In a specific embodiment, the punching target holder 40 may include a transverse concave support 42 attached to an upright concave support 44. In a specific embodiment, the transverse concave support 42 may be attached in a generally perpendicular orientation relative to the upright concave support 44 so that the punching target holder 40 may be in the form of a "cross" or "T" configuration. In a specific embodiment, opposite ends of the transverse concave support 42 may each include an aperture through which hooks 46 of an attachment cord or strap 48 (e.g., a bungee cord) may be engaged with the transverse concave support 42 to attach the punching target holder 40 to the punching bag 38. In a specific embodiment, to prevent marring or scratching of the punching bag 38, the ends of the transverse and upright concave supports 42 and 44 may be provided with foam end pieces 50. The transverse concave support 42 includes a socket 52 adapted to receive and engage the neck support 16 and thereby support and attach the punching target 18 to the punching bag 38. The neck support 16 may be secured to the socket 52 in any known manner, such as with a bolt or screw 54, for example, as shown in FIG. 9, and as also discussed above regarding the manner in which the neck support 16 may be secured to the socket 13 and the elongated support 12, as shown in FIG. 2. In a specific embodiment, the socket 52 may extend upwardly at an angle away from the transverse concave support 42.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A combat training device comprising:

an elongated support having a rearward end, a forward end and a sleeve housing, the sleeve housing including a longitudinal bore;

the elongated support having a shoulder rest at the rearward end of the elongated support;

the elongated support having a socket at the forward end of the elongated support and a neck support removably engaged with the socket;

a punching target connected to the neck support; and a punching member mounted to a forward end of a reciprocating support and longitudinally moveable relative to the punching target, the reciprocating support slidably disposed within the longitudinal bore of the sleeve housing.

2. The combat training device of claim 1, wherein the shoulder rest is a butt stock.

3. The combat training device of claim 1, wherein the shoulder rest is an inverted "J" member adapted to be hooked over a human shoulder.

4. The combat training device of claim 1, wherein the neck support extends upwardly away from the elongated support at an angle.

5. The combat training device of claim 1, wherein the punching target is in the shape of a human head.

6. The combat training device of claim 1, wherein the neck support is resilient and having a static position, and adapted to return to its static position after impact with a punching force.

7. The combat training device of claim 1, wherein the neck support with the attached punching target is removably attached to the elongated support.

8. The combat training device of claim 1, wherein the elongated support further includes a plurality of apertures at its rearward end and a moveable support attached to the shoulder rest and including a detent for releasable and locking engagement with one of the apertures.

9. A combat training device comprising:

an elongated support having a rearward end, a forward end and a sleeve housing, the sleeve housing including a longitudinal bore;

a punching target connected to the forward end of the elongated support; and a reciprocating support slidably disposed within the longitudinal bore of the sleeve housing and moveable between a rearward position and a forward position, the reciprocating support including a handle at a rearward end thereof and a punching member at a forward end thereof, the punching member being longitudinally moveable relative to the punching target.

10. The combat training device of claim 9, wherein the longitudinal bore of the sleeve housing is generally parallel to the elongated member and the reciprocating support.

11. The combat training device of claim 9, wherein the reciprocating support is rotatable within the longitudinal bore of the sleeve housing.

12. The combat training device of claim 9, further including a neck support attached to the punching target, and the neck support being removably attached to the forward end of the elongated support.

13. The combat training device of claim 12, wherein the forward end of the elongated support further includes a socket and the neck support with attached punching target is removably attachable to the socket.

14. The combat training device of claim 9, wherein the elongated support further includes a shoulder rest at the rearward end of the elongated support.

15. The combat training device of claim 14, wherein the shoulder rest comprises one of a buttstock and an inverted "J" member.

16. The combat training device of claim 9, wherein the elongated support further includes a plurality of apertures at its rearward end and a moveable support attached to a shoulder rest and including a detent for releasable and locking engagement with one of the apertures.

17. A combat training device comprising:

an elongated support having a rearward end, a forward end and a sleeve housing, the sleeve housing including a longitudinal bore, the forward end of the elongated support including a socket and a neck support removably engaged with the socket;

a punching target connected to the neck support at the forward end of the elongated support, wherein the punching target is resiliently attached to the elongated support in a static position and is adapted to return to its static position after impact with a punching force; and a punching member mounted to a forward end of a reciprocating support and longitudinally moveable relative to the punching target, the reciprocating support slidably disposed within the longitudinal bore of the sleeve housing.

18. A combat training device comprising:

an elongated support having a rearward end and a forward end;

a punching target connected to the forward end of the elongated support; and a reciprocating support slidably moveable relative to the elongated support between a rearward position and a forward position, and including a punching member at a forward end of the reciprocating support, the punching member being longitudinally moveable relative to the punching target, wherein the elongated support further includes a sleeve housing having a longitudinal passageway, the longitudinal passageway being disposed in generally parallel relationship to the elongated support, the reciprocating support being disposed for reciprocating movement within the longitudinal passageway.

19. The combat training device of claim 18, wherein the reciprocating support is rotatable within the longitudinal passageway of the sleeve housing.

* * * * *